United States Patent [19]

Bauer et al.

[11] 4,408,448

[45] Oct. 11, 1983

[54] YARN FALSE TWISTING METHOD AND APPARATUS

[75] Inventors: Karl Bauer; Peter Dammann, both of Remscheid; Hermann Kubler, Remscheid-Lüttringhausen; Hellmut Lorenz, Remscheid, all of Fed. Rep. of Germany

[73] Assignee: Barmag Barmer Maschinenfabrik AG, Remscheid, Fed. Rep. of Germany

[21] Appl. No.: 273,217

[22] Filed: Jun. 12, 1981

[30] Foreign Application Priority Data

Sep. 8, 1980 [DE] Fed. Rep. of Germany ..... 3033683

[51] Int. Cl.[3] ..... D02G 1/04; D01H 7/92

[52] U.S. Cl. ..... 57/336; 57/348

[58] Field of Search ..... 57/334–340, 57/348, 349

[56] References Cited

U.S. PATENT DOCUMENTS

| | | | |
|---|---|---|---|
| 2,863,280 | 12/1958 | Ubbelohde | 57/336 X |
| 2,991,614 | 7/1961 | Ubbelohde | 57/336 |
| 3,045,416 | 7/1962 | Ubbelohde | 57/336 X |
| 4,047,373 | 9/1977 | Takai | 57/336 |
| 4,144,700 | 3/1979 | Takai et al. | 57/336 X |
| 4,144,701 | 3/1979 | Takai et al. | 57/336 |
| 4,248,038 | 2/1981 | Takai | 57/336 |
| 4,296,598 | 10/1981 | Faure | 57/336 X |
| 4,377,932 | 3/1983 | Dammann et al. | 57/336 |

FOREIGN PATENT DOCUMENTS 586296 6/1975 Switzerland .

*Primary Examiner*—John Petrakes

*Attorney, Agent, or Firm*—Bell, Seltzer, Park & Gibson

[57] ABSTRACT

A method and apparatus of false twisting a yarn is disclosed which utilizes a pair of endless belts mounted in crossing relation to define a twisting zone therebetween, and a pressure applying member for locally biasing at least one of the belts toward the other at the twisting zone. The yarn is advanced along a path of travel through the twisting zone, and the acute angle formed between each belt and the yarn path of travel is adjusted so as to generally correspond to the desired twist angle of the yarn in its twisted condition. Further, the speed of each belt is adjusted so as to optimize the yarn tension conditions both preceding and following the belts. To achieve an essentially slipless operation, the pressure exerted by the biasing means is adjustably controlled so that the torque exerted by the belts exceeds the natural restoring torque of the yarn.

8 Claims, 5 Drawing Figures

YARN FALSE TWISTING METHOD AND APPARATUS

The present invention relates to an improved yarn false twisting method and apparatus, of the type disclosed in commonly owned copending application Ser. No. 168,735, filed July 14, 1980 now abandoned, and continuation in part application Ser. No. 219,329, filed Dec. 22, 1980, now U.S. Pat. No. 4,377,932.

In copending application Ser. No. 168,735, there is disclosed a friction false twist apparatus which comprises at least one endless belt mounted for rotation to define a twisting zone between opposing friction surfaces. A pressure applying member is mounted adjacent the back side of at least one belt for biasing the belt toward the other surface locally at the twisting zone and so as to firmly engage the yarn passing therethrough. Further, it is known that the crossing angle of the belts may be suitably adjusted.

It is an object of the present invention to provide a yarn false twisting method and apparatus of the above type, and wherein the crossing angle of each belt with respect to the yarn path of travel is adjusted so that it corresponds to the angle of the desired twist of the yarn in its twisted condition, and wherein the belt speed B may be adjusted so that the ratio of belt speed B and yarn speed Y is defined by the formula $$\frac{B}{Y} = \frac{1}{\text{Cosine alpha}} \times (1 \pm 20\%)$$

It has been found that the above adjustments result in an optimal adaptation of the friction false twist apparatus in an optimal adaptation of the friction false twist apparatus to the desired impartation of twist, and in addition, in optimizing the yarn tension conditions. In this regard, it is particularly important that the ratio of the yarn tension following the friction false twist apparatus and the tension preceding the apparatus does not exceed a predetermined value, and preferably is one to one.

It is also an aspect of the present invention to provide for an essentially slipless operation, which is made possible by insuring that the contact pressure exerted by the pressure applying member exceeds the restoring torque of the yarn.

It has previously been proposed in German Publication (OS) No. 2,310,803 that in a friction false twist apparatus consisting of three axes rotating in the same direction and carrying discs which overlap each other between the axes, the center to center distance of the axes and/or the axial arrangement of the discs may be selected so that the angle between the direction of the disc rotation and the thread line equals the angle of twist. This relationship is provided to enable a slipless operation. However, it has not heretofore been considered that for a passage of yarn without slip or with a controlled amount of slip the geometrical conditions between travelling twisting surface and yarn as well as operational conditions concerning speeds and frictional forces have to be correlated to each other but independently of one another. This is a requirement that a friction false twist apparatus according to the above German Publication is unable to provide.

It is accordingly an object of the present invention to provide for optimizing the texturing process and imparting false twist to a yarn, and wherein all decisive parameters including the slip can be adjusted independently of each other in a friction false twist apparatus of the type described in copending application No. 168,735.

The above and other objects and advantages of the present invention are achieved by providing that the crossing angle between the belts may be adjusted, so as to obtain a defined ratio of the twist component and the yarn conveyance component of the belt speed. In addition, the belt speed is correlated to the crossing angle to obtain optimal tension ratios.

Some of the objects and advantages of the invention having been stated, others will appear as the description proceeds, when taken in connection with the accompanying drawings, in which FIG. 1 is a top plan view of a yarn false twisting apparatus which embodies the present invention;

Figure 1:
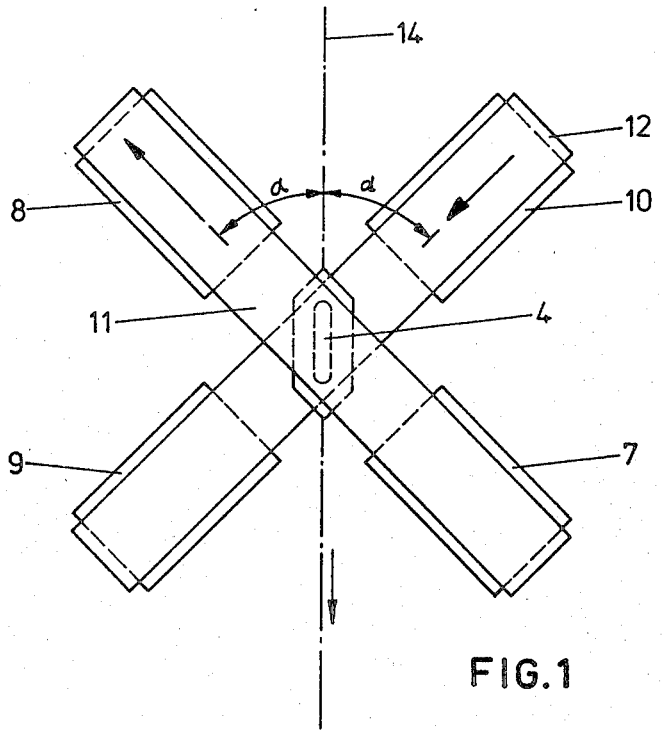
Figure 2:
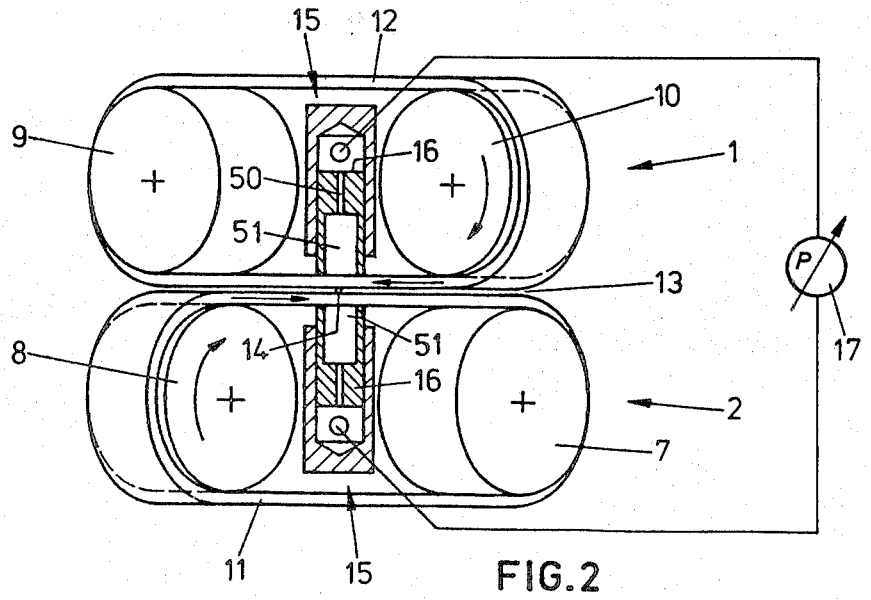
FIG. 2 is a side elevation view, partly sectioned, of the apparatus shown in FIG. 1.

Referring more particularly to the drawings, FIGS. 1 and 2 illustrate a yarn false twisting apparatus embodying the method of the present invention, and which comprises a pair of twist imparting assemblies 1 and 2. A member 1 is in the form of a relatively thin, flexible endless belt 12 which is mounted for rotation between a pair of mounting rollers 9 and 10. The member 2 of this preferred embodiment comprises a second like belt 11, which is mounted for rotation between the mounting rollers 7 and 8. The outer face of the lower run of the belt 12 is disposed in an opposing, substantially non-contacting relationship with the outer face of the upper run of the belt 11, and defines a gap 13 therebetween. A yarn 14 is advanced along a line which bisects the angle formed by the two crossing belts, and through the area in which the opposing belts 11 and 12 overlap, i.e., the twisting zone 4.

Each belt is pressed against the yarn in the area of the twisting zone by respective pressure applying members 15, each of which consists of a cylinder-piston assembly. The pistons 16 are actuated by compressed air from an adjustably supply 17. In addition, a portion of the compressed air is supplied through the partially throttled axial duct 50 to the air cushion chamber 51, to thereby provide air lubrication between the front face of the piston and the associated belt surface.

Figure 4:
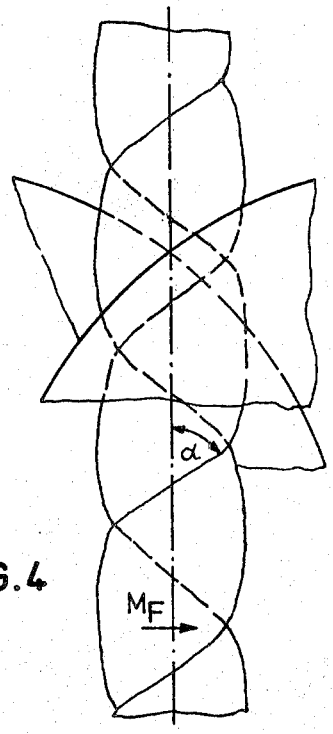
FIG. 4 is an enlarged view of a portion of the yarn in its twisted condition.
Figure 5:
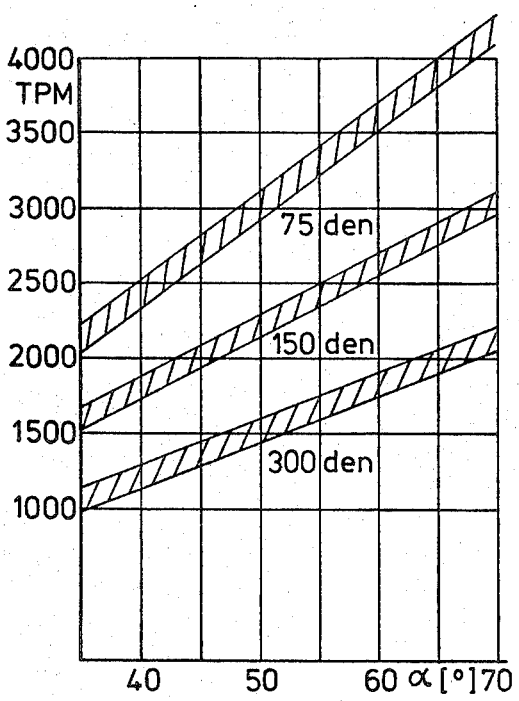
FIG. 5 is a schematic diagram showing the interrelation of denier, desired twist, and crossing angle.

To adjust to the optimal operating conditions, the angle of twist alpha is first determined from the yarn denier and preset number of twist per meter or inch of yarn length. It should be noted that the angle of twist is the angle in the twisted state of the yarn, as shown in FIG. 4 and that in imparting the twist, the yarn receives a geometrical modification which essentially consists of an increased diameter and a decreased length. Therefore, the angle of twist in the geometrical condition differs somewhat from the angle of twist resulting from mere calculation based upon the yarn length and yarn diameter in the untwisted condition. For this reason, the angle of twist should be determined by measuring in the desired twisted condition. The crossing angle alpha of the belts, as shown in FIG. 1, is then conformed to the desired angle of twist. The diagram in FIG. 5 shows a summary of the procedure for a selected range of deniers, consisting of determining the angle of twist and adjusting the crossing angle. The desired twist is indicated by the yarn twists per meter.

Figure 3:
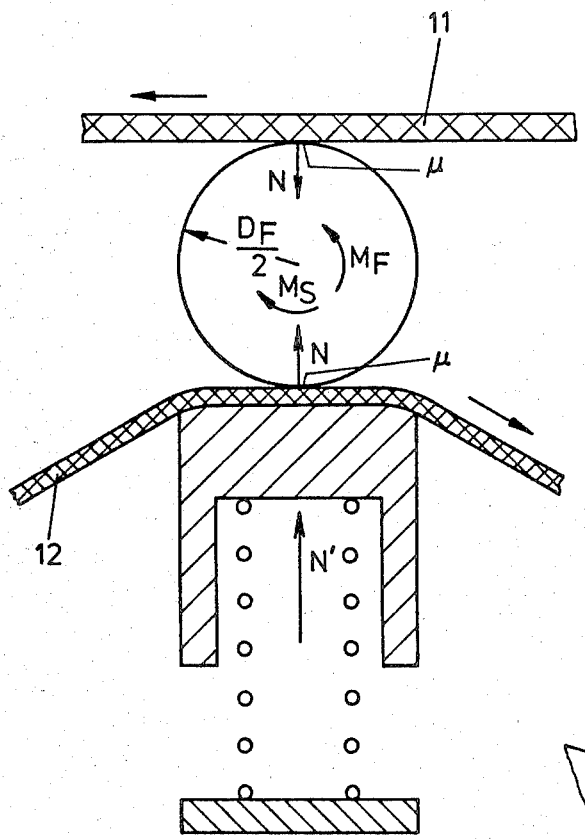
FIG. 3 is a schematic diagram of the moments, forces and geometric relations of the yarn.

After the crossing angle has been adjusted, the pressure acting on piston 16 is so adjusted at pressure supply 17 that it results in a predetermined normal force which acts upon the yarn in the twisting zone. As shown in FIG. 3, $$MS = N \times u \times \frac{DF}{2}$$

and wherein MS is the torque exerted by the belts, N is the normal force exerted by the belts on the yarn, u is the friction coefficient between the belts and the yarn, DF is the yarn diameter. MS should exceed MF, which is the restoring moment or torque of the yarn.

As to the restoring moment, it should be noted that the yarn, and particularly the yarn while under tension in the twisting zone, is a torsionally elastic structure which possesses a certain restoring moment. Among other things, this restoring moment also depends on the amount of twist imparted, as well as the degree of heating in the false twist zone.

If the above specified relation is maintained, it is also insured that the yarn is conveyed without significant slip and false twisted. Thus a particularly careful treatment of the yarn is achieved. It should also be noted that a slip free operation is not always desired. The occurrence of a certain slip may be very desirable for reducing the false twist and regulating the yarn tension.

Also in accordance with the present invention, it is preferable to adjust the yarn tensions. This is accomplished where a certain yarn speed is preset, at a speed which depends on the machine design and in addition, on the process parameters, such as heat transfer and the time the yarn remains in the heating zone. The belt speed is then adjusted, applying the following formula $$B = \frac{Y}{\text{Cosine alpha}} \times (1 \pm 20\%),$$

and where B equals the belt speed, Y equals the yarn speed, and alpha is the crossing angle as illustrated in FIG. 1.

As a result, when the relation B equals Y divided by cosine alpha is maintained, the yarn tension preceding the friction false twisting apparatus may be maintained identical to, or at least approximately the same as the tension following the friction false twist apparatus, and within an accuracy of ±20%. As will be apparent, one particular advantage of the invention is the fact that the twisting and conveyance conditions can be adjusted independently of the yarn tension conditions.

In the drawings and specification, there has been set forth a preferred embodiment of the invention, and although specific terms are employed, they are used in a generic and descriptive sense only and not for purposes of limitation.

That which is claimed is:

1. A method of false twisting a yarn characterized by the ability to impart a desired twist to a running yarn under optimal tension conditions, and comprising the steps of rotating a pair of endless belts mounted in crossing relation with the opposing surfaces disposed in opposing, substantially non-contacting relationship so as to define a twisting zone between the opposing surfaces thereof, while advancing a yarn at a speed (Y) along a path of travel through said twisting zone, locally biasing at least one of said belts toward the other belt at said twisting zone so as to have twist imparted to the advancing yarn by the frictional contact between the yarn and opposed surfaces, and with the biasing force being substantially limited to an area which is coincident to the path of the running yarn, adjusting the relative orientation of the belts such that the acute angle (alpha) formed between each belt and the yarn path of travel substantially corresponds to the desired twist angle of the yarn in the twisted condition, and adjusting the speed of each belt (B) according to the formula $$B = \frac{Y}{\text{Cosine alpha}} \times (1 \pm 20\%).$$

2. The method as defined in claim 1 wherein the step of locally biasing at least one of said belts toward the other belt includes adjusting the biasing force such that the torque exerted on the yarn by the belts is greater than the restoring moment of the yarn in its twisted condition, to thereby minimize slippage of the yarn between the belts.

3. A yarn false twisting apparatus characterized by the ability to impart twist to a running yarn under optimal tension conditions, and comprising a pair of endless belts mounted in crossing relation with the opposing surfaces disposed in opposing substantially non-contacting relationship so as to define a twisting zone between the opposing surfaces thereof, means for advancing a yarn at a speed (Y) along a path of travel through said twisting zone, means for locally biasing at least one of said belts toward the other belt at said twisting zone so as to have twist imparted to the advancing yarn by the frictional contact between the yarn and opposed surfaces, and such that the biasing force is substantially limited to an area which is coincident to the path of the running yarn, means for adjusting the relative orientation of the belts such that the acute angle (alpha) formed between each belt and the yarn path of travel substantially corresponds to the desired twist angle of the yarn in the twisted condition, and means for operatively rotating said belts at a speed (B) determined by the formula $$B = \frac{Y}{\text{Cosine alpha}} \times (1 \pm 20\%).$$

4. The apparatus as defined in claim 3 wherein said means for locally biasing at least one of said belts toward the other belt includes means for adjusting the biasing force such that the torque exerted on the yarn by the belts is greater than the restoring moment of the yarn in its twisted condition, to thereby minimize slippage of the yarn between the belts.

5. A method of false twisting a yarn characterized by the ability to impart a desired twist to a running yarn under optimal tension conditions, and comprising the steps of rotating an endless belt mounted in crossing relation to a yarn path, while locally biasing said belt toward the yarn path to thereby define a twisting zone, and with the biasing force being substantially limited to an area which is coincident to the path of the running yarn, advancing a yarn at a speed (Y) along said path of travel through said twisting zone so as to have twist imparted thereto by the frictional contact between the yarn and the belt in said twisting zone, adjusting the relative orientation of the belt and the yarn path such that the acute angle (alpha) formed between said belt and the yarn path of travel substantially corresponds to the desired twist angle of the yarn in the twisted condition, and adjusting the speed of said belt (B) according to the formula $$B = \frac{Y}{\text{Cosine alpha}} \times (1 \pm 20\%).$$

6. The method as defined in claim 5 comprising the further step of adjusting the biasing force such that the torque exerted on the yarn by the belt is greater than the restoring moment of the yarn in its twisted condition, to thereby minimize slippage of the yarn with respect to the belt.

7. The method as defined in either claim 5 or 6 comprising the further step of providing a supporting surface adjacent the twisting zone for supporting the yarn on the side opposite the belt and so that the yarn is nipped between the belt and supporting surface.

8. The method as defined in claim 7 comprising the further step of maintaining the opposing surfaces of the rotating endless belt and the supporting surface in substantially non-contacting relationship to minimize friction therebetween.

* * * * *